US006286580B1

(12) United States Patent
Ward et al.

(10) Patent No.: US 6,286,580 B1
(45) Date of Patent: Sep. 11, 2001

(54) SAND RECLAMATION

(75) Inventors: Stuart P. Ward, Warwickshire; Robert Simpson, Staffordshire, both of (GB)

(73) Assignee: Foseco International Limited, Swindon (GB)

( * ) Notice: Subject to any disclaimer, the term of this patent is extended or adjusted under 35 U.S.C. 154(b) by 0 days.

(21) Appl. No.: 09/308,802

(22) PCT Filed: Oct. 29, 1997

(86) PCT No.: PCT/GB97/02971

§ 371 Date: Jun. 11, 1999

§ 102(e) Date: Jun. 11, 1999

(87) PCT Pub. No.: WO98/22240

PCT Pub. Date: May 28, 1998

(30) Foreign Application Priority Data

Nov. 22, 1996 (GB) ..... 9624340

(51) Int. Cl.[7] ..... B22C 1/16
(52) U.S. Cl. ..... 164/5; 164/520; 164/525
(58) Field of Search ..... 164/5, 520, 525

(56) References Cited

U.S. PATENT DOCUMENTS 4,391,642 * 7/1983 Stevenson et al. ..... 106/38.23
4,504,314 * 3/1985 Barker et al. ..... 106/38.35
4,867,228 * 9/1989 Novelli et al. ..... 164/525
5,238,976 8/1993 Iyer .
5,271,450 12/1993 Bailey .
5,567,743 10/1996 Busby et al. .

FOREIGN PATENT DOCUMENTS 55 014126 A 1/1980 (JP) .
59 212 144 A 12/1984 (JP) .

* cited by examiner

*Primary Examiner*—Tom Dunn
*Assistant Examiner*—Len Tran
(74) *Attorney, Agent, or Firm*—Nixon & Vanderhye P.C.

(57) ABSTRACT

A carbohydrate is added to sand, which has been used to make foundry moulds or cores, and which has been bonded using an alkaline resol phenol-formaldehyde resin, prior to reclamation of the sand by a thermal reclamation. The thermal reclamation may be done in other equipment, for example, a rotary thermal reclamation unit, but is preferably done in a fluidized bed reclamation unit. The carbohydrate is preferably water soluble and is added to the used sand as an aqueous solution. The carbohydrate may be for example a monosaccharide, such as glucose, mannose, galactose or fructose, or a disaccharide such as sucrose, maltose or lactose. The carbohydrate may also be a carbohydrate derivative such as a polyhydric alcohol (e.g., ethylene glycol, glycerol, pentaerythritol, xylitol, mannitol or sorbitol), a sugar acid (e.g., gluconic acid), or a polysaccharide derivative (e.g., a starch hydrolysate, i.e., a glucose syrup or a dextrin). The amount of carbohydrate used in the reclamation process is usually of the order of 0.25% to 5.0% by weight based on the weight of used sand.

14 Claims, No Drawings

SAND RECLAMATION

This invention relates to the reclamation of sand, for example silica sand, which has been used to produce moulds and cores in foundries, and in particular to the reclamation of sand which has been bonded with an alkaline resol phenol-formaldehyde resin in order to produce the moulds and cores.

When used to make foundry moulds and cores sand is mixed with one of a variety of binders such as bentonite clay, sodium silicate or a resin. Due to the effect of exposure to metal casting temperatures and contact with molten metal the sand becomes contaminated with binder decomposition products, metallic particles and other debris. The sand must therefore be replaced by new sand when making further moulds and cores, or if the sand is to be reused it must first be treated to remove at least some of the contaminants.

Due to the cost of virgin sand and the cost of disposal of used sand, and also due to the strict regulations which now exist governing the disposal of waste materials in land fill sites, foundries now wish to increase the level of reclaimed sand which they use.

If sand is to be reclaimed successfully the reclamation process must not only restore the condition of the sand by breaking down agglomerates and removing particles of metal, but the process must also enable the reclaimed sand to be reused, preferably with the same type of binder as before.

In recent years there have been introduced a number of methods of mould and core production which utilise an aqueous alkaline solution of a resol phenol-formaldehyde resin as the binder. In one such method the resin is cured by means of an ester which is mixed with the sand and the resin. In another method the mixed sand and resin is formed to the desired shape, and the resin is cured by passing a vaporised ester such as methyl formate through the formed shape. In another method in which curing of the resin is achieved by complexing the resin with borate ions, the binder used contains both the resin and the borate ions and the alkalinity of the binder solution is such that complexing is prevented. After forming of the sand-binder composition carbon dioxide gas is passed through the formed shape, thereby reducing the pH of the binder and triggering cross-linking by the borate ions.

One process which is commonly used to reclaim foundry sand is a dry attrition process in which the sand is subjected to a rubbing or abrasive action, which breaks up agglomerates into individual particles, and which removes adhering binder residues from the sand particles. The binder residues and fine sand particles are then removed by classification. The dry attrition process on its own is insufficient as a viable process for reclaiming sand which has been bonded with an alkaline resol phenol-formaldehyde resin. The attrition process does not remove all the resin residues from the sand particles, and the re-bonding properties of the reclaimed sand are inferior when compared to the bonding properties of new sand. As a consequence the dry attrition process usually allows re-use of only up to about 80% of the resin bonded sand, so this means that the remainder has to be disposed of. As the used sand contains a high level of phenolic and alkaline residues disposal is more of a problem and more costly compared with the disposal of some other used foundry sands.

Another process which is commonly used to treat used foundry sand is a thermal reclamation process in which the used sand is heated to a sufficiently high temperature to remove any binder residues which are present. In one type of thermal reclamation process a rotary unit is used and in this process lumps of agglomerated used sand or crushed used sand are fed to the unit. In another thermal reclamation process the thermal treatment is done in a furnace having a fluidised bed, and the used sand which is fed to the furnace is first subjected to an attrition process so as to break down agglomerates into individual particles. A thermal reclamation process which utilises a fluidised bed is described in GB-A-2244939. Thermal reclamation is usually carried out at a temperature of the order of 400 to 800° C.

In practice there are problems in reclaiming foundry sand which has been bonded with an alkaline resol phenol-formaldehyde resin, by a thermal process, particularly when the thermal treatment is done in a fluidised bed, because the individual particles of used sand tend to re-agglomerate during the process. Due to the presence of an appreciable quantity of alkali in the resin binder, the used sand contains sodium or potassium compounds (usually potassium compounds, because it has been found that potassium is more beneficial than sodium in such resin binders), and it is believed that during the thermal treatment these alkaline compounds on the surface of the sand particles decompose or melt and cause the sand particles to fuse together.

In rotary thermal reclamation units there may be sufficient sand on sand attrition to prevent fusion between individual sand particles from taking place. However, although the fused bond is relatively weak, it is not readily broken in a fluidised bed reclamation unit, and the agglomerates formed by the fusion of the particles prevent the fluidising gas from maintaining an effective fluidised bed. As a result blockage, and ultimately failure of the unit can occur.

It would be possible to remove the alkaline compounds from the used sand by washing and drying the sand prior to thermal reclamation. However the washing treatment and subsequent drying would add considerably to the cost of the reclamation process, and would be uneconomic.

It has also been proposed to incorporate additives in the used sand prior to the thermal reclamation process in order to prevent fusion of the sand particles. WO 94/05448 describes the use of an additive, for example a halogen acid, sulphuric acid, boric acid or an ammonium salt of such acids such as ammonium chloride, which will convert the potassium hydroxide and other salts in used sand which had been bonded with an ester-cured phenolic resin into a potassium compound having a melting point above 550° C. WO 94/26439 describes the use of a clay of particle size less than 0.5 mm, such as a kaolin or a montmorillonite, which will react with elutable alkali contained in the used sand.

These additives suffer from disadvantages. They themselves, or compounds which they produce by chemical reaction with the alkali, remain in the sand after the reclamation process, and can have deleterious effects when the reclaimed sand is used to make moulds or cores. Acidic additives suffer from the additional disadvantage that they can corrode components of the reclamation equipment.

It has now been found that the thermal reclamation of used foundry sand which has been bonded using an alkaline resol phenol-formaldehyde resin can be improved if prior to the thermal treatment of the used sand a carbohydrate material is mixed with the sand.

According to the invention there is provided a process for thermally reclaiming sand which has been used to make foundry moulds or cores and which has been bonded using an alkaline resol phenol-formaldehyde resin, comprising subjecting lumps of the used and bonded sand to attrition in order to break up the lumps into individual sand grains, adding a carbohydrate to the sand grains in the amount of 0.25% to 5.0% by weight based on the weight of the used sand, and subjecting the sand to thermal treatment in a thermal reclamation apparatus, such that the carbohydrate is removed from the sand by combustion.

The thermal reclamation treatment may be done in other equipment, such as a rotary thermal reclamation unit, but the treatment is preferably done in a fluidised bed reclamation unit, and prior to the addition of the carbohydrate additive, the sand is subjected to dry attrition to break down lumps and agglomerates of used sand into individual particles, and then classified. The fluidised bed reclamation unit may be apparatus of the type described in GB-A-2244939.

Accordingly, in a preferred embodiment of the invention the sand which has been subjected to attrition in order to break up the lumps into individual sand grains, is also subjected to classification to remove fines, and the thermal treatment is carried out in a fluidised bed reclamation apparatus or a rotary reclamation apparatus.

The additive should be capable of forming an interface between individual sand particles and preventing fusion bonding of the particles when the particles are thermally treated, and the additive is removed from the sand by the thermal treatment without producing hazardous decomposition materials and without leaving any residues which could affect the properties of the sand when it is reused in the foundry.

In the context of the present invention the term carbohydrate includes not only carbohydrates themselves but also carbohydrate derivatives.

The carbohydrate is preferably a water soluble carbohydrate because it is preferred to add the carbohydrate to the sand as a solution in order to disperse the carbohydrate thoroughly in the sand mass. The carbohydrate may be for example a monosaccharide such as glucose, mannose, galactose or fructose or a disaccharide such as sucrose, maltose or lactose. The carbohydrate may also be a derivative such as a polyhydric alcohol. Examples of suitable polyhydric alcohols include ethylene glycol, which can be considered to be a derivative of the simplest monosaccharide glycolaldehyde ($CH_2OH.CHO$), glycerol, which is a derivative of the monosaccharide glyceraldehyde ($CH_2OH.CHOH.CHO$), pentaerythritol, which is a derivative of an aldotetrose, pentahydric alcohols such as xylitol, which is a derivative of the aldopentose xylose, and hexahydric alcohols such as mannitol, which is a derivative of the aldohexose mannose, or sorbitol, which is a derivative of either of the aldohexoses glucose and gulose. The carbohydrate may also be a derivative such as a sugar acid, for example gluconic acid. Polysaccharides or their derivatives may also be used, Examples of a suitable polysaccharide derivative are starch hydrolysates, i.e. glucose syrups or dextrins. However some polysaccharides and polysaccharide derivatives, for example starch, cellulose ethers and sodium carboxymethylcellulose are less desirable as they are not readily water soluble and can cause an increase in viscosity of the water, thus making them more difficult to disperse in the sand. An impure carbohydrate material such as molasses may also be used.

The amount of carbohydrate additive used is of the order of 0.25% to 5.0% by weight based on the weight of used sand, and will vary depending on the amount of resin residues, and hence organic matter and alkali, which may be present. The optimum quantity required for the sand of a particular foundry can readily be determined by preliminary tests, such as loss on ignition and elutable potassium content of the sand to be thermally reclaimed.

When used in a thermal sand reclamation process according to the invention the carbohydrate additive gives a number of advantages.

The carbohydrate additive prevents sand grain fusion and this is particularly advantageous when the thermal treatment is done in a fluidised bed unit. Since the additive is organic it completely combusts during the thermal treatment process and leaves no undesirable residues which could affect rebonding properties when the reclaimed sand is reused. The preferred carbohydrate additives are water soluble so they can readily be dispersed in the sand as an aqueous solution, and their addition to the sand can be accurately controlled using simple pump metering devices. The additive is non-hazardous and will not corrode metallic components in the thermal reclamation unit.

The following Examples will serve to illustrate the invention:

EXAMPLE 1

10 tonnes of a used steel sand which had been bonded with an ester-cured potassium alkaline resol phenol-formaldehyde resin were treated in an attrition unit to reduce lumps and agglomerates to grain size. 1.5% by weight based on the weight of the sand of a 65% w/w aqueous sucrose solution was added to the sand and thoroughly dispersed, and the sand was then treated at 700° C. in a fluidised bed thermal reclamation unit of the type described in GB-A-2244939. No fusion bonding of the sand particles occurred during the thermal reclamation. The content of organic matter as indicated by the loss on ignition, and the elutable potassium content, were measured prior to and after the thermal treatment, and the results are recorded in Table 1 below.

The loss on ignition values were determined by accurately weighing 10–20 g samples of the sand before and after heating in a furnace at 1000° C. for 1 hour, and expressing the difference in the two weights as a percentage of the weight of the sample before heating.

The elutable potassium content of the sand at ambient temperature was determined by means of a Jenway Flame Photometer using a potassium filter and by comparing the meter readings for the samples against meter readings for known standards.

TABLE 1

| | LOSS ON IGNITION | POTASSIUM CONTENT |
|---|---|---|
| SAND BEFORE THERMAL TREATMENT | 1.48% | 0.130% |
| SAND AFTER THERMAL TREATMENT | 0.06% | 0.008% |

EXAMPLE 2

2 tonnes of a similar sand to that used in Example 1, but from an aluminium foundry, were reclaimed as described in Example 1, at a bed temperature of approximately 660° C. Prior to thermal reclamation 1.5% by weight based on the weight of the sand of a 65% w/w aqueous solution of sucrose was dispersed in the sand. Some fusion bonding of the sand particles occurred during the thermal reclamation, so the test was repeated using a 2.0% addition of the sucrose solution instead of 1.5%. No fusion bonding of the sand particles occurred. The loss on ignition and the elutable potassium content were measured before and after the thermal treatment, and the results are recorded in Table 2 below.

TABLE 2

| | LOSS ON IGNITION | POTASSIUM CONTENT |
|---|---|---|
| SAND BEFORE THERMAL TREATMENT | 2.82% | 0.220% |
| SAND AFTER THERMAL TREATMENT | 0.06% | <0.005% |

A comparison of Table 2 with Table 1 shows that the aluminium foundry sand contained significantly higher levels of organic matter and potassium, and this is the reason why more carbohydrate additive was need to successfully reclaim the aluminium foundry sand.

EXAMPLE 3

Some of the thermally reclaimed sand from Example 1 was rebonded using 1.3% by weight based on the weight of the sand of an aqueous solution of a potassium alkaline resol phenol-formaldehyde resin, FENOTEC (trade mark) FX, available from Foseco, and 20% by weight based on the weight of resin of triacetin as curing agent. Standard 50 mm×50 mm diameter cylindrical AFS test cores were prepared immediately after mixing the sand, resin and curing agent, and the compression strength of the cores was determined after various time intervals. As a comparison the test was repeated using virgin Windsor Rose silica sand, a quarried sand having a fineness number of AFS 50. The compression strength measurements are shown in Table 3 below.

TABLE 3

| TIME | COMPRESSION STRENGTH ($kN/m^2$) THERMALLY RECLAIMED SAND | COMPRESSION STRENGTH ($kN/m^2$) WINDSOR ROSE SAND |
|---|---|---|
| 1 HOUR | 820 | 810 |
| 2 HOURS | 988 | 1235 |
| 4 HOURS | 2030 | 1704 |
| 24 HOURS | 2964 | 2485 |

EXAMPLE 4

A series of aqueous carbohydrate additive solutions as listed in Table 4 below were tested in a process for thermally reclaiming sand according to the invention.

TABLE 4

| ADDITIVE | CARBOHYDRATE | SOLIDS CONTENT | SOLUTION VISCOSITY (BROOKFIELD) |
|---|---|---|---|
| 1 | Sucrose | 65% | 152 cP |
| 2 | Dextrose Monohydrate (D-Glucose) | 45% | 12.5 cP |
| 3 | Gluconic acid | 50% | 20 cP |
| 4 | Starch Hydrolysate (Glucose Syrup)-Dextrose Equivalent 17–21 | 50% | 105 cP |
| 5 | Starch Hydrolysate (Yellow Dextrin)-TACKIDEX (trade mark) DF165 ex Roquette | 50% | 255 cP |
| 6 | D-Sorbitol | 70% | 170 cP |
| 7 | Molasses (Sugar Syrup) | 65% | 118 cP |

Sand which had been bonded with an ester-cured potassium alkaline resol phenol-formaldehyde resin, and which had been used to make foundry cores against which steel had been cast, was mechanically treated in an attrition unit to break down lumps of the sand to grain size, and fines wereremoved by classification. One tonne of the treated sand was mixed with the additives in the amounts indicated in Table 5 using a mobile continuous mixer. The sand was then thermally reclaimed in a Richards Gas Fired Thermal Reclaimer.

The sand was fed into the fluid bed furnace of the reclaimer via a small hopper attached to a rotating screw feeder. The rotational speed of the screw feeder was adjusted in each test to maintain as near as possible a feed rate of 250 kg per hour, and the bed temperature was maintained at approximately 600° C. At the end of the feeding operation, which was typically 4 hours, the thermally reclaimed sand was collected as it left the cooler classifier of the reclaimer. 25 kg samples of sand were collected over a period of 30 to 40 minutes for reuse as foundry sand. 1 kg samples of sand prior to and after thermal reclamation treatment were also taken for determination of loss on ignition and of potassium content using the methods described in Example 1.

The loss on ignition and potassium content results are shown in Table 5 below.

TABLE 5

| | FS 1601 | | | | | | | | | |
|---|---|---|---|---|---|---|---|---|---|---|
| ADDITIVE | 1 | 1 | 1 | 1 | 2 | 3 | 4 | 5 | 6 | 7 |
| Addition level (% by weight of solution based on sand weight) | 0.5 | 1.5 | 4.0 | 7.0 | 2.15 | 1.95 | 1.95 | 1.95 | 1.5 | 1.5 |
| Additive solids (% by weight based on sand weight) | 0.325 | 0.975 | 2.60 | 5.25 | 0.967 | 0.975 | 0.975 | 0.975 | 1.05 | 0.975 |
| Sand before Thermal Treatment | | | | | | | | | | |
| Loss in Ignition (%) | 1.07 | 1.06 | 1.33 | 1.24 | 1.18 | 1.04 | 0.98 | 1.06 | 1.03 | 1.07 |
| Potassium content (%) | 0.15 | 0.16 | 0.17 | 0.17 | 0.18 | 0.14 | 0.14 | 0.15 | 0.16 | 0.16 |
| Sand after Thermal Treatment | | | | | | | | | | |
| Loss in ignition (%) | 0.04 | 0.00 | 0.01 | 0.00 | 0.01 | 0.00 | 0.01 | 0.00 | 0.04 | 0.04 |
| Potassium Content (%) | 0.03 | 0.03 | 0.02 | 0.02 | 0.04 | 0.03 | 0.02 | 0.02 | <0.005 | 0.06 |

Each of the thermally reclaimed sands was tested by rebonding the sand using 1.5% by weight of FENOTEC FX resin, and 20% by weight based on the weight of the resin of a curing agent consisting of 70% by weight triacetin and 30% by weight 1,3 butylene glycol diacetate. Standard DIN transverse strength square section test cores (22.4×22.4×172.5 mm) were produced immediately after mixing the sands the resin and the curing agent, and the transverse strength was measured after various time intervals on a Georg Fischer PFG universal sand test machine. Tests were also done for comparison purposes on a sample of the same sand which had been only mechanically reclaimed by attrition, and on a sample of new Windsor Rose silica sand, using the same quantities of resin binder and curing agent. The transverse strength values in kg/cm$^2$ are recorded in Table 6 below.

TABLE 6

| | | | FS 1601 | | | | | | | | | |
|---|---|---|---|---|---|---|---|---|---|---|---|---|
| SAND | MR[1] | NEW[2] | TR[3] | TR | TR | TR | TR | TR | TR | TR | TR | TR |
| ADDITIVE | — | — | 1 | 1 | 1 | 1 | 2 | 3 | 4 | 5 | 6 | 7 |
| ADDITION LEVEL | | | 0.5% | 1.5% | 4.0% | 7.0% | 2.15% | 1.95% | 1.95% | 1.95% | 1.5% | 1.5% |
| TIME FROM MIXING | | | | | | | | | | | | |
| 30 MINUTES | 1.0 | 5.0 | 7.0 | 7.0 | 6.0 | 6.0 | 8.0 | 8.0 | 8.5 | 6.0 | 3.5 | 7.5 |
| 1 HOUR | 2.0 | 10.0 | 13.0 | 12.0 | 10.0 | 12.5 | 13.5 | 14.5 | 15.0 | 13.0 | 12.5 | 14.0 |
| 2 HOURS | 3.0 | 14.0 | 18.0 | 15.5 | 15.0 | 15.5 | 16.0 | 16.0 | 19.0 | 16.5 | 16.5 | 17.5 |
| 4 HOURS | 3.0 | 16.5 | 19.0 | 19.5 | 18.0 | 18.0 | 18.5 | 21.5 | 22.0 | 21.0 | 19.5 | 20.0 |
| 24 HOURS | 4.5 | 24.0 | 29.5 | 28.0 | 26.0 | 23.0 | 27.0 | 32.5 | 32.0 | 31.0 | 27.0 | 35.0 |

[1]MR is mechanically reclaimed sand.
[2]NEW is new Windsor Rose silica sand (AFS Fineness No. 50).
[3]TR is thermally reclaimed sand produced by the process of the invention.

EXAMPLE 5

Used core sand from a German iron foundry, consisting of Frechen F34 sub-angular silica sand (AFS Fineness No. 67), which had been bonded with 2.4% by weight of ECOLO-TEC (trade mark) 2541 resin (an alkaline aqueous resol phenol-formaldehyde resin containing boron ions of the type described in European Patent No. 323096 and available from Foseco) cured by passing carbon dioxide gas through the cores, was mechanically attrited to break up lumps and reduce the sand to grain size. The loss on ignition and potassium content were the determined on a samples of the sand using the methods described in Example 1. 2% by weight based on the weight of the sand of a 65% by weight aqueous sucrose solution were then added to the sand, and the sand was reclaimed thermally using the method described in Example 4 at a temperature of approximately 600° C. The loss on ignition and the potassium content of the thermally reclaimed sand were then determined by the same methods as used in Example 1.

The loss on ignition and potassium contents are recorded in Table 7 below.

TABLE 7

| | LOSS ON IGNITION | POTASSIUM CONTENT |
|---|---|---|
| SAND BEFORE THERMAL TREATMENT | 1.85% | 0.22% |
| SAND AFTER THERMAL TREATMENT | 0.07% | <0.005% |

The properties of the reclaimed sand described were compared with those of new Frechen F34 silica sand bonded with the same amount of the same resin. Standard DIN 22.5×22.5×172.5 mm transverse specimen bars were produced in a PBK transverse strength core box having a carbon dioxide gassing attachment using a GF PRA sand rammer. The cores were gassed with carbon dioxide to cure the resin for either 15 seconds or 30 seconds at a flow rate of 6 liters per minute and a pressure of 5 psi. The transverse strength of the cores was then measured, as in Example 4, 15 seconds after gassing, after storage for 1 hour, after storage for 24 hours under ambient conditions (20° C., 45% relative humidity), and after storage for 24 hours under humid storage conditions (15–20° C., 65% relative humidity). The transverse strength results expressed in kg/cm$^2$ are shown in Table 8 below.

TABLE 8

| GASSING TIME | 15s | 30s |
|---|---|---|
| Frechen F34 New Sand | | |
| AS-Gassed Strength | 7.8 | 8.3 |
| 1 Hour Storage Strength | 12.5 | 12.8 |
| 24 Hours Ambient Storage Strength | 15.3 | 13.5 |
| 24 Hours Humid Storage Strength | 12.3 | 11.3 |
| Thermally Reclaimed Sand | | |
| As-Gassed Strength | 6.5 | 7.8 |
| 1 Hour Storage Strength | 11.0 | 11.3 |
| 24 Hours Ambient Storage Strength | 14.0 | 14.5 |
| 24 Hours Humid Storage Strength | 12.5 | 13.5 |

EXAMPLE 6

The process of the invention was carried out on used Sibelco sand from a Brazilian steel foundry operating an AMS Foundry Sand Reclaim System thermal reclamation unit consisting of a rotary kiln (1.22 m in diameter and 7.92 m in length) followed by a rotary cooler (0.76 m in diameter and 6.10 m in length) operating at a rate of throughput of sand of 910 kg per hour. The rotary kiln had two zones, the first at approximately 450° C., and the second at approximately 700° C., and the residence time of the sand in the rotary kiln was approximately 45 minutes. The sand had been bonded using 1.8% by weight of FENOTEC 810 resin, a sodium/potassium alkaline resol phenol-formaldehyde resin, based on the weight of the sand 20% by weight of triacetin based on the weight of the resin as curing agent. In two separate tests, 1.5% based on the weight of the sand of a 65% by weight aqueous sucrose solution was added to the sand, and the sand was thermally reclaimed. The loss on ignition and the potassium content of the sand were determined before and after thermal reclamation using the methods described in Example 1, and the results obtained are shown in Table 9 below.

TABLE 9

| | LOSS ON IGNITION | POTASSIUM CONTENT |
|---|---|---|
| SAND BEFORE THERMAL TREATMENT | 0.50% | 0.31% |
| SAND AFTER THERMAL TREATMENT - TEST 1 - ZONE 1 TEMPERATURE 470° C. | 0.00% | 0.032% |
| SAND AFTER THERMAL TREATMENT - TEST 2 - ZONE 1 TEMPERATURE 500° C. | 0.00% | 0.026% |

The properties of the thermally reclaimed sand from the two tests were compared with those of the same sand which had been reclaimed by mechanical reclamation, and with new Sibelco sand. Each of the sands was bonded with 1.3% by weight based on the weight of sand of FENOTEC 810 resin, and the resin was cured with 20% by weight of triacetin based on the weight of the resin. The sand temperature was 25° C. Standard AFS imperial dog bone tensile strength cores having a 2.54 cm×2.54 cm (1 inch×1 inch) central section were produced immediately after mixing the sand, the resin and the curing agent, and the tensile strength of the cores was measured after various time intervals on a Dietert universal sand strength machine fitted with a tensile core accessory. The results obtained converted to kg/cm$^2$ are shown in Table 10 below.

TABLE 10

| SAND | MECHANICALLY RECLAIMED | NEW SIBELCO SAND | THERMALLY RECLAIMED TEST 1 | THERMALLY RECLAIMED TEST 2 |
|---|---|---|---|---|
| 1 HOUR | 2.0 | 3.2 | 3.5 | 3.3 |
| 2 HOURS | 2.8 | 4.8 | 4.4 | 4.8 |
| 3 HOURS | 5.1 | 7.5 | 7.9 | 7.0 |
| 24 HOURS | 6.8 | 10.3 | 10.2 | 10.0 |

In the results of the above Examples the loss on ignition values after thermal reclamation compared with the corresponding values prior to thermal reclamation show that the process of the invention removes all, or substantially all of the phenolic residues from the sand. Similarly, the values for the potassium content after thermal reclamation compared with the corresponding values prior to thermal reclamation show that the process removes all, or substantially all of the potassium residues from the sand.

In all the Examples there was no evidence of sand fritting or fusion taking place, and hence there was no risk of blocking or failure of the thermal reclamation equipment.

The results of the strength measurement tests in Examples 3 to 6 show that the process of the invention produces a reclaimed sand which on re-use has bonding properties which are at least comparable with those of virgin sand of the same type, and which are significantly better than those of the same type of sand which has only been reclaimed mechanically.

What is claimed is:

1. A process for thermally reclaiming sand which has been used to make foundry moulds or cores and which has been bonded using an alkaline resol phenol-formaldehyde resin, comprising the sequential steps of:

(a) subjecting lumps of the used and bonded sand to attrition in order to break up the lumps into individual sand grains, (b) adding a carbohydrate to the sand grains in an amount of 0.25% to 5.0% by weight based on the weight of the used sand, and (c) subjecting the sand to thermal treatment in a thermal reclamation apparatus, such that the carbohydrate is removed from the sand by combustion.

2. A process according to claim 1, further comprising the step of (a1) classifying the sand to remove fines subsequent to the attrition of the sand, and wherein the thermal reclamation apparatus comprises a fluidised bed reclamation apparatus or a rotary reclamation apparatus.

3. A process according to claim 1, wherein the carbohydrate is added to the sand as an aqueous solution.

4. A process according to claim 1, wherein the carbohydrate is a monosaccharide, a disaccharide or a polysaccharide.

5. A process according to claim 4, wherein the carbohydrate is glucose, mannose, galactose, fructose, sucrose, maltose, lactose or starch.

6. A process according to claim 1, wherein the carbohydrate is a carbohydrate derivative.

7. A process according to claim 6, wherein the carbohydrate derivative is a polyhydric alcohol.

8. A process according to claim 7, wherein the polyhydric alcohol is ethylene glycol, glycerol, pentaerythritol, xylitol, mannitol or sorbitol.

9. A process according to claim 6, wherein the carbohydrate derivative is a sugar acid or a starch hydrolysate.

10. A process according to claim 9, wherein the sugar acid is gluconic acid.

11. A process according to claim 9, wherein the starch hydrolysate is a glucose syrup or a dextrin.

12. A process according to claim 6, wherein the carbohydrate derivative is a cellulose ether or sodium carboxymethylcellulose.

13. A process according to claim 1, wherein the carbohydrate is an impure carbohydrate material.

14. A process according to claim 13, wherein the impure carbohydrate material is molasses.

* * * * *